US012601237B2

(12) United States Patent
Soerheim et al.

(10) Patent No.: US 12,601,237 B2
(45) Date of Patent: Apr. 14, 2026

(54) TEMPORARY SUSPENSION OF COMPLETED HYDROCARBON WELLS

(71) Applicant: CONOCOPHILLIPS COMPANY, Houston, TX (US)

(72) Inventors: Jan Ove Soerheim, Tananger (NO); Lars Albertsen, Tananger (NO); Rune Woie, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 18/304,121

(22) Filed: Apr. 20, 2023

(65) Prior Publication Data

US 2023/0340856 A1 Oct. 26, 2023

Related U.S. Application Data

(60) Provisional application No. 63/335,050, filed on Apr. 26, 2022.

(51) Int. Cl.

| | |
|---|---|
| ***E21B 33/04*** | (2006.01) |
| ***E21B 33/12*** | (2006.01) |
| ***E21B 34/06*** | (2006.01) |
| ***E21B 47/06*** | (2012.01) |

(52) U.S. Cl.

CPC ..... *E21B 33/1208* (2013.01); *E21B 33/04* (2013.01); *E21B 34/06* (2013.01); *E21B 47/06* (2013.01)

(58) Field of Classification Search

CPC ..... E21B 33/035; E21B 34/063; E21B 34/10; E21B 33/1208; E21B 33/1294

See application file for complete search history.

(56) References Cited

U.S. PATENT DOCUMENTS

| | | | | |
|---|---|---|---|---|
| 3,901,314 | A | 8/1975 | Nutter | |
| 6,039,119 | A | 3/2000 | Hopper et al. | |
| 7,909,104 | B2 * | 3/2011 | Bjorgum | E21B 33/134 166/376 |
| 8,220,538 | B2 * | 7/2012 | Wee | E21B 33/134 166/387 |

(Continued)

FOREIGN PATENT DOCUMENTS

| | | | |
|---|---|---|---|
| NO | 20191144 | A1 | 3/2021 |
| WO | 2007108701 | A1 | 9/2007 |

(Continued)

OTHER PUBLICATIONS

International Search Report for PCT/US2023/066027 mailed Aug. 24, 2023; 3 pgs.

*Primary Examiner* — Tara Schimpf
*Assistant Examiner* — Ursula Lee Norris

(57) ABSTRACT

In the process of suspending a subsea hydrocarbon well (1) after finalizing the completion operation and prior to stimulation of the well and putting the well on production, preinstalled upper and lower glass plugs (11, 12) are used as temporary barriers in the tubing. The plugs allow various tests to be performed before the lower plug (12), below the production packer (10), is broken; the upper plug (11) located above the downhole safety valve (13) then forms one of the barriers required to suspend the well whilst the Blow Out Preventer (BOP) is removed and Xmas tree installed, at which point the upper plug (11) is broken.

8 Claims, 1 Drawing Sheet

(56) References Cited

U.S. PATENT DOCUMENTS

| | | | | |
|---|---|---|---|---|
| 8,307,905 | B2 * | 11/2012 | Bjorgum | E21B 23/0421 166/386 |
| 9,051,811 | B2 * | 6/2015 | Bussear | E21B 43/128 |
| 9,222,322 | B2 * | 12/2015 | Brandsdal | E21B 33/12 |
| 9,567,829 | B2 * | 2/2017 | Pogoson | E21B 33/129 |
| 9,835,023 | B2 | 12/2017 | Hallundback et al. | |
| 9,850,734 | B2 * | 12/2017 | Wee | E21B 33/12 |
| 10,030,472 | B2 | 7/2018 | Fripp | |
| 10,472,925 | B2 * | 11/2019 | Hiorth | E21B 33/134 |
| 10,544,654 | B2 | 1/2020 | Bjorgum et al. | |
| 10,655,413 | B2 * | 5/2020 | Brandsdal | E21B 34/063 |
| 10,683,728 | B2 | 6/2020 | Kellner et al. | |
| 10,808,489 | B2 | 10/2020 | Hiorth | |
| 10,883,328 | B2 | 1/2021 | Brandsdal | |
| 10,934,802 | B2 | 3/2021 | Brandsdal | |
| 2005/0028980 | A1 * | 2/2005 | Page | E21B 33/1294 166/373 |
| 2012/0255738 | A1 * | 10/2012 | Lauderdale | E21B 34/101 166/373 |
| 2013/0133883 | A1 * | 5/2013 | Hill, Jr. | E21B 33/10 166/66 |
| 2014/0305629 | A1 | 10/2014 | Bisset et al. | |
| 2015/0204155 | A1 * | 7/2015 | Patel | E21B 33/12 166/360 |
| 2016/0024878 | A1 | 1/2016 | June et al. | |
| 2016/0251931 | A1 * | 9/2016 | Buchan | E21B 33/064 166/360 |
| 2016/0281455 | A1 * | 9/2016 | Brandsdal | E21B 33/12 |
| 2021/0040816 | A1 * | 2/2021 | Hiorth | E21B 34/063 |
| 2021/0277736 | A1 * | 9/2021 | Dockweiler | E21B 23/06 |

FOREIGN PATENT DOCUMENTS

| | | | |
|---|---|---|---|
| WO | 2016195508 | A1 | 12/2016 |
| WO | 2020216649 | A1 | 10/2020 |

* cited by examiner

TEMPORARY SUSPENSION OF COMPLETED HYDROCARBON WELLS

CROSS-REFERENCE TO RELATED APPLICATIONS

This application is a non-provisional application which claims benefit under 35 USC § 119(e) to U.S. Provisional Application Ser. No. 63/335,050 filed Apr. 26, 2022, entitled "Temporary Suspension of Completed Hydrocarbon Wells," which is incorporated herein in its entirety.

STATEMENT REGARDING FEDERALLY SPONSORED RESEARCH

None.

FIELD OF THE INVENTION

This invention relates to the temporary suspension of a hydrocarbon well after finalizing the completion operation and prior to stimulation of the well and putting the well on production. The invention is particularly applicable to subsea wells, i.e. offshore hydrocarbon wells with a wellhead located on the seafloor. Also, the invention can have advantages in platform wells.

BACKGROUND OF THE INVENTION

Once a hydrocarbon well has been drilled and cased, the well is completed by cleaning it out and setting production tubing. The well then needs to be sealed temporarily while the Xmas tree is installed on the wellhead and pending stimulation of the well prior to being placed on production.

The process of sealing the well typically involves setting temporary plugs using wireline techniques. This involves the use of a specialized vessel (e.g. riserless light well intervention vessel) to remove the temporary plugs in procedures that can take up to a day. It is desirable to reduce the cost and delay involved in setting and removing the plugs, as well as the risk posed by this procedure—wireline released plugs can get stuck if left for a long time.

Another type of temporary plug is a so-called glass plug. This is a frangible plug that is designed to break under certain conditions thereby effectively removing it. The plug may be designed to break after a certain period of time or when a certain combination of pressure pulses is applied, for example. Glass plugs therefore do not require wireline to remove them. They are pre-installed in a tubing joint.

Glass plugs have been used in a wide variety of situations. To the inventors' knowledge, a single glass plug is only ever used. This may be because the glass plugs are normally opened by triggering a mechanism to shatter the plug by applying a sequence of pressure pulses; there may be a perceived risk that application of the incorrect sequence may shatter the incorrect plug if more than one is used. It is essential that the barriers are opened sequentially and at the correct time. Other methods of breaking plugs, e.g. a device for breaking the plug after a certain time, may also be prone to error.

For the above reasons, the applicant believes that glass plugs have not, to date, been used in the temporary suspension of completed wells.

One known type of glass plug is described in WO2007/108701A1 in the name Bjorgum Mekaniske AS.

BRIEF SUMMARY OF THE DISCLOSURE

The invention more particularly includes a process for suspending a hydrocarbon well, wherein the process comprises:

a) installing and completing casing and liner in the hydrocarbon well;
b) running into the well a tubing string and hanging the tubing string from a tubing hanger in a wellhead;
c) wherein the tubing string is fitted with pre-installed upper and a lower frangible plugs, and wherein the frangible plugs have selectively closable bypass channels in an initial open configuration;
c) performing pressure tests on the tubing hanger and other downhole components;
d) whilst the upper frangible plug creates a seal in the tubing, removing the wellhead and installing a Xmas tree.

Optionally, the upper and lower frangible plugs may be breakable by application of respective first and second predetermined sequences of pressure pulses. Optionally, the upper and lower frangible plug may each have a bypass channel including a valve and wherein the valves are closable by means of respective third and fourth predetermined sequences of pressure pulses, in which case step (c) may involve the bypass channel of the lower frangible plug being closed by applying the fourth predetermined sequence of pressure pulses prior to setting of a production packer and pressure testing of the tubing string. Step (c) may also involve shattering the lower frangible plug by applying the second predetermined sequence of pressure pulses prior to pressure testing the production packer. Step (c) may also involve the bypass channel of the upper frangible plug being closed by applying the third predetermined sequence of pressure pulses prior to pressure testing the upper frangible plug.

Following pressure testing of the upper frangible plug the BOP may be removed and the Xmas tree may be installed. Following installation of the Xmas tree the upper frangible plug may be shattered by applying the first predetermined sequence of pressure pulses.

The upper frangible plug would normally be located in the tubing above the downhole safety valve. The lower frangible plug would normally be located in the tubing below the production packer. Other configurations may be used dependent upon the requirements for pressure testing and the location of the frangible plug.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead, these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
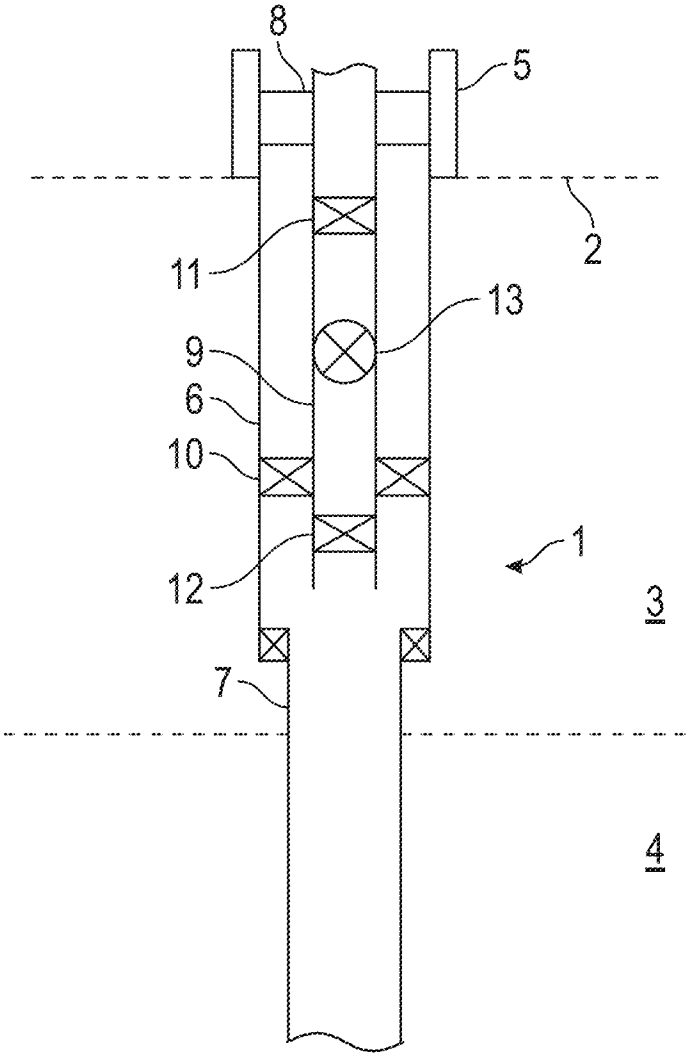
FIG. 1 is a schematic section through a well, showing production tubing fitted with glass plugs in accordance with the invention.

As shown in FIG. 1, a subsea hydrocarbon well 1 passes through the seafloor 2, through overburden rock 3 and into a hydrocarbon-bearing reservoir 4. A wellhead 5 is located on the seafloor 2. The wellhead would normally be located within a subsea template structure along with other wellheads, but this is omitted for clarity. Casing 6 is suspended from the wellhead 5; the well continues downward with one or more further lengths of casing of decreasing diameter. The final length of casing, known as the reservoir liner 7, extends into the reservoir 4. For clarity only the first length of casing 6 and the reservoir liner 7 is shown.

Suspended from a tubing hanger 8 in the wellhead 5 is a length of production tubing 9, which extends inside the casing 6. A production packer 10 is installed between the production tubing 9 and casing 6. During the well construction a Blowout Preventer (BOP) is the last barrier for well control. The BOP (Not shown) is connected to the wellhead 5. The BOP will be removed to enable installation of a Xmas tree for well production/injection purposes. However, to remove the BOP two independent tested barriers are required.

Upper and lower glass plugs 11, 12 are installed in the tubing, respectively above and below the conventional downhole safety valve 13. The lower plug 12 is also below the production packer 10.

A glass plug is in essence a barrier made from a material that may be broken intentionally by some means at a chosen time. The barrier element or elements of such plugs are frequently made from glass, which is a material that can have considerable strength in certain circumstances but is easy to shatter. Features are included in the plug design for breaking the glass—this might be by means of pressure or application of a pointed tool to create a stress multiplier in the glass or a combination of these, or by other means. The plug also includes design features to allow the time at which the glass is broken to be chosen. For example, a timing device may be included that activates the glass breaking feature after a set time. Alternatively, a device may be included that senses pressure and activates the glass breaking feature when a certain pattern of pressure pulses is detected. In this way, a "signal" comprising pulses of pressure in the well fluid may be sent from the surface to initiate breaking the of the glass. Once the glass is broken, the fragments simply fall to the bottom of the well where they have no effect on operations.

Glass plugs are provided with a bypass channel to allow fluids to flow past the plugs if desired. The opening or closing of the bypass channel can be controlled in a similar manner to the breaking of the plug, e.g. by pressure pulses.

Figure 2:
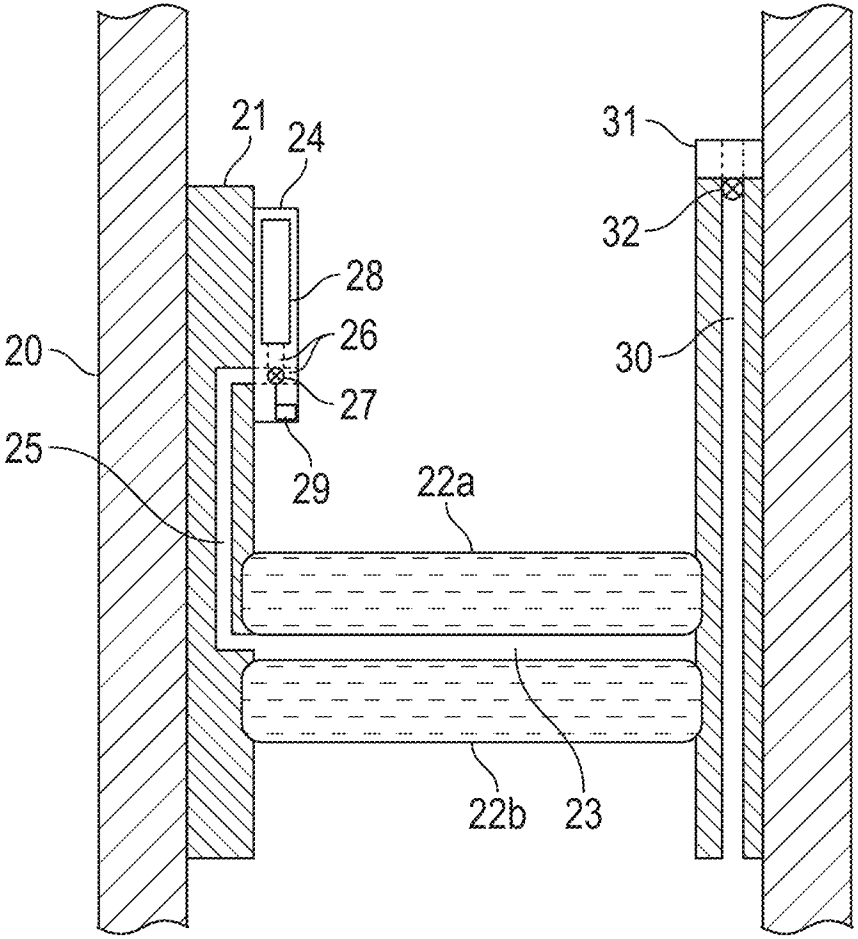
FIG. 2 is a sectional view showing a highly schematically represented glass plug.

A conventional glass plug is shown in highly stylised form in FIG. 2. There are many types of glass plug and the plug shown in FIG. 2 is only one example; the skilled person will be familiar with other types. The exact construction of the glass plug is not the subject of this patent application.

The plug of FIG. 2 is shown installed in tubing 20. It comprises a tubular support member 21, which is secured in tubing 20 by conventional well known means (not shown). Secured within the tubing 21 are upper and lower frangible barrier elements 22*a*, 22*b*, which are made from glass. The barrier elements are separated by a small gap 23. A pressure control channel 25 within the support member 21 opens at one end into the gap 23 between the barrier elements 22 *a,b*. At the other end, the channel 25 communicates with channels 26 within a control unit 24 located on the inner wall of the support member 21. The control unit includes a valve 27 that may be set to open the channel 25 either to the interior of the tubing on the proximal side of the barrier elements 22 *a,b* (i.e. the side nearer the surface) or to an atmospheric pressure chamber 28. The valve is controlled by a pressure sensing/valve actuating unit shown at 29. The unit 29 is designed to respond to a predetermined sequence of pulses to initiate breaking of the glass by changing the pressure between the elements 22 *a,b*.

Also in the support member 21 is a bypass channel 30. The bypass channel 30 allows communication between the parts of the tubing 20 that are proximal and distal of the barrier plugs 22 *a,b*. At one end of the bypass channel 30 is a control unit 31 that allows control of whether the bypass channel is open or not. Again, the unit 31 is designed to respond to a predetermined sequence of pulses to initiate closing the bypass channel, which is open on installation of the plug.

A sequence of operations will now be described with reference to FIG. 1, showing the function of the glass plugs. Tubing 9 is installed in the well 1, suspended from the tubing hanger 8. Pre-installed in the tubing are upper and lower glass plugs 11, 12. Near the top of the tubing but below the upper glass plug 11 is a conventional downhole safety valve 13, which is in its normal open position. In their initial configuration both glass plugs have their bypass channels open. The first stage is to test the tubing hanger seals, prior to setting the production packer 10. For this operation, completion fluid is passed down the tubing 9 under pressure, passing through the bypass channels of the glass plugs 11,12 and then back up the annulus between casing 6 and production tubing 9 (production pack 10 in FIG. 1 is not in place yet, so the fluid can pass up the annulus). Any leakage at the tubing hanger 8 can thereby be detected and remedied.

Once the tubing hanger has been tested, a specific cycle of pressure pulses, or pressure signature, is then passed down the production tubing to activate a bypass closure valve 32 in the bypass channel 30 of the lower glass plug 12, so that the plug now blocks the bore of the tubing 9 at a point near the end of the tubing. The production packer 10 is set by conventional means. An inflow test is then performed on downhole safety valve by managing the pressures in the tubing an annulus between the tubing and casing.

The next stage is to apply a specific sequence of pressure pulses, or pressure signature, in the tubing 9 to trigger the shattering of the lower glass plug 12. The production packer 10 is then tested in the directional flow. Next, the bypass of upper glass plug 11 is closed by applying a sequence of pressure pulses. The upper glass plug 11 is then tested by applying pressure from above.

If the upper glassplug is found to be effective then the downhole safety valve 13 can be closed, thereby forming with the upper glass plug 11 the required double barrier to allow the BOP to be removed. The wellhead can then be fitted with a Xmas tree to allow production to start. Once the Xmas tree is in place with its various valves, the upper glass plug can be shattered by applying a sequence of pressure pulses, or pressure signature. The downhole safety valve can be returned to its normal open position.

The use of a glass plug for the upper barrier means that the wireline operations can be dispensed—with entirely for the completion process, with considerable saving in time and cost.

The above sequence of steps would normally be performed using wireline plugs, therefore requiring the use of a wireline intervention vessel. By using glass plugs only, the need for a wireline intervention vessel is removed, thereby saving considerable time and cost.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. U.S. Pat. No. 3,901,314, Nutter, "Pressure Controlled Tester Valve," Schlumberger Tech. Corp. (1975).
2. U.S. Pat. No. 9,835,023, Hallundbaek, et al., "Barrier Testing Method," WellTec AS (2015).
3. U.S. Ser. No. 10/030,472, Fripp, "Frangible Plug to Control Flow Through a Completion," Halliburton Energy Services (2016).
4. U.S. Ser. No. 10/544,654, Bjorgum & Hiorth, "Well Tool Device with a Frangible Disc," Vosstech AS (2019).
5. U.S. Ser. No. 10/683,728, Kellner, et al., "Float Sub with Pressure-Frangible Plug," Innovex Downhole Solutions Inc. (2018).
6. U.S. Ser. No. 10/808,489, Hiorth, "Well Tool Device with a Frangible Glass Body," Interwell Norway AS (2018).
7. U.S. Ser. No. 10/883,328, Brandsdal, "Holding and Crushing Device for Barrier Plug," TCO AS (2018).
8. U.S. Ser. No. 10/934,802, Brandsdal, "Plug Arrangement," Frac Tech AS (2019).
9. EP3303761, Brandsdal & Tveranger, "Destruction Mechanism for a Dissolvable Sealing Device," TCO AS (2018).
10. WO2007/108701, Bjoergum, "Sealing Device," Bjoergum Mekaniske AS (2007).

The invention claimed is:

1. A process for suspending a subsea hydrocarbon well, wherein the process comprises:

a) installing and completing a casing and a liner in the hydrocarbon well;

b) running into the well a tubing string and hanging the tubing string from a tubing hanger in a wellhead; wherein the tubing string is fitted with a pre-installed upper glass plug and a pre-installed lower glass plug, wherein the upper glass plug and the lower glass plug each comprise an upper frangible barrier element and a lower frangible barrier element, wherein the upper frangible barrier element and the lower frangible barrier element are separated by a gap, wherein a pressure control channel opens into the gap at a first end, wherein the upper glass plug is breakable by a first predetermined sequence of pressure pulses and the lower glass plug is breakable by a second predetermined sequence of pressure pulses, wherein the first predetermined sequence of pressure pulses and the second predetermined sequence of pressure pulses initiate breaking of the upper glass plug and the lower glass plug, respectively, by changing the pressure between the respective upper frangible barrier and the lower frangible barrier of each glass plug, wherein the upper glass plug and the lower glass plug each have a selectively closable bypass channel in an open configuration, wherein the selectively closable bypass channel comprises a bypass closure valve, wherein the bypass closure valve of the upper glass plug is closable by means of a third predetermined sequence of pressure pulses and the bypass closure valve of the lower glass plug is closable by means of a fourth predetermined sequence of pressure pulses, and wherein no wireline intervention vessel is involved in the process for suspending the hydrocarbon well;

c) performing pressure tests on the tubing hanger and other downhole components;

d) removing a blowout preventer from the wellhead and installing a Xmas tree while the upper glass plug creates a seal in the tubing.

2. The process according to claim 1, wherein the upper glass plug is located in the tubing above a downhole safety valve.

3. The process according to claim 1, wherein the lower glass plug is located in the tubing below a production packer.

4. The process according to claim 1, wherein step (c) involves the bypass channel of the lower glass plug being closed by applying the fourth predetermined sequence of pressure pulses prior to setting of a production packer and pressure testing of the tubing string.

5. The process according to claim 4, wherein step (c) involves shattering the lower glass plug by applying the second predetermined sequence of pressure pulses prior to pressure testing the production packer.

6. The process according to claim 5, wherein step (c) involves the bypass channel of the upper glass plug being closed by applying the third predetermined sequence of pressure pulses prior to pressure testing the upper glass plug.

7. The process according to claim 6, wherein following pressure testing of the upper glass plug a blowout preventer is removed from the wellhead and the Xmas tree installed.

8. The process according to claim 7, wherein following installation of the Xmas tree the upper glass plug is shattered by applying the first predetermined sequence of pressure pulses.

* * * * *